US005991557A

United States Patent [19]

Kunishi et al.

[11] Patent Number: 5,991,557

[45] Date of Patent: Nov. 23, 1999

[54] IMAGE FORMING APPARATUS HAVING A CHARGING MEMBER WITH PLURAL CHARGING MODES

[75] Inventors: Tsuyoshi Kunishi, Ibaraki-ken; Takeo Yamamoto; Keizo Takura, both of Toride, all of Japan

[73] Assignee: Canon Kabushiki Kaisha, Tokyo, Japan

[21] Appl. No.: 09/027,319

[22] Filed: Feb. 20, 1998

[30] Foreign Application Priority Data

Feb. 21, 1997 [JP] Japan ..... 9-054113

[51] Int. Cl.[6] ..... G03G 15/02; G03G 21/00

[52] U.S. Cl. ..... 399/45; 399/50; 399/176

[58] Field of Search ..... 399/45, 50, 89, 399/174, 176

[56] References Cited

U.S. PATENT DOCUMENTS 5,412,455 5/1995 Ono et al. ..... 399/176
5,420,671 5/1995 Kisu et al. ..... 399/174
5,444,519 8/1995 Motoyama et al. ..... 399/50
5,512,982 4/1996 Takahashi et al. ..... 355/219
5,734,947 3/1998 Tanabe ..... 399/45

FOREIGN PATENT DOCUMENTS 5-11571 1/1993 Japan .

*Primary Examiner*—Fred L. Braun
*Attorney, Agent, or Firm*—Fitzpatrick, Cella, Harper & Scinto

[57] ABSTRACT

An image forming apparatus includes a photosensitive body, a charging member for charging the photosensitive body, voltage applicator for applying a voltage including an AC component to the charging member, exposing device for image exposing on the photosensitive body charged by the charging member to form an electrostatic image, and developer for developing the electrostatic image, wherein the image forming apparatus can select from a first mode having low tone reproductivity and a second mode having tone reproductivity higher than that of the first mode, and wherein, when the second mode is selected, the voltage applicator applies a voltage having a frequency of the AC component higher than that when the first mode is selected.

7 Claims, 9 Drawing Sheets

IMAGE FORMING APPARATUS HAVING A CHARGING MEMBER WITH PLURAL CHARGING MODES

BACKGROUND OF THE INVENTION

1. Field of the Invention

The present invention relates to an image forming apparatus such as a copying machine, a laser beam printer and the like, and more particularly, it relates to an image forming apparatus having a charging means for charging a surface of an image bearing body.

2. Related Background Art

As image forming apparatuses of this kind, there are electrophotographic copying machines and electrophotographic printer, for example. In such apparatuses, an electrostatic latent image is formed by illuminating image exposure light corresponding to an original image or an inputted multi-value image signals onto a surface of an image bearing body uniformly charged by a charging means, and the electrostatic latent image is developed by a developing means to form a toner image. Then, the toner image is transferred onto a transfer material by a transfer means, and then, the transfer material is conveyed to a fixing means, where the toner image is fixed to the transfer material, and then, the transfer material is outputted as an imaged product (print, copy).

As an example of a charging device used with the above-mentioned image forming apparatus, there is a charging device of contact charging type as shown in FIG. 9. A charge roller (charging member) 11 is obtained by surrounding a metallic core 19 by a semi-conductive elastic member 20. The charge roller 11 is urged against an image bearing body 10 with predetermined pressure by means of a pressurizing means (not shown) and is rotatingly driven in a direction shown by the arrow L by rotation of the image bearing body 10 in a direction shown by the arrow K.

In synchronous with image formation, when charging bias voltage including AC component and DC component is applied from a charging bias voltage source 30 to the core 19 of the charge roller 11, the surface of the image bearing body 10 is charged with potential substantially equal to the DC component of the charging bias voltage. Hereinafter, the charging system of this kind is referred to as "AC bias contact charging type".

However, the charging device of AC bias contact charging type has a disadvantage that charge unevenness corresponding to frequency of the AC component of the charging bias voltage is generated.

FIG. 10 shows an example of the charge unevenness as distribution of electrification (charging) potential. In FIG. 10, the abscissa indicates a position on the surface of the image bearing body 10 along a rotational direction of the image bearing body 10, and the ordinate indicates charging potential on the surface of the image bearing body 10. The period of the charge unevenness corresponds to the frequency of the AC component of the charging bias voltage. The charge unevenness results in unevenness in density of the toner image after developing and, accordingly, unevenness in density of the outputted image, thereby worsening the image quality considerably.

It is known that, as the frequency of the AC component of the charging bias voltage is increased, such charge unevenness is gradually decreased.

On the other hand, the charging device of AC bias contact charging type has a disadvantage that, if the frequency of the AC component of the charging bias voltage is increased, the damage on the surface of the image bearing body is increased.

In the charging device of AC bias contact charging type, when the charging bias voltage including the AC component is applied to the charging member contacted with the surface of the image bearing body, a very strong electric field having alternating polarity is generated near a pole of the surface of the image bearing body. The alternating electric field generates a large amount of plasma ions and accelerates the ions. As a result, there arises a phenomena that, when the large amount of accelerated plasma ions strike against the surface of the image bearing body, the surface of the image bearing body is scraped. (This phenomena is referred to as "scraping phenomenon of surface of image bearing body due to contact charging" hereinafter).

That is to say, when the frequency of the AC component of the charging bias voltage is increased, since the number of ion collisions against the surface of the image bearing body is increased, the scraping phenomenon of surface of image bearing body due to contact charging becomes more noticeable.

If the scraping of the surface of the image bearing body is continued to make the photosensitive layer and insulation layer (of the surface of the image bearing body) thinner, the following disadvantages arise.

Firstly, if the photosensitive layer and insulation layer (of the surface of the image bearing body) are made thinner, the surface of the image bearing body is apt to be damaged. Secondly, as the electrostatic capacity of the surface of the image bearing body is increased, the charge amount required for obtaining the predetermined charging potential is also increased, with the result that the adequate charging potential cannot be obtained. And, the charging bias voltage source must made bulky to compensate such poor charging.

In conclusion, the conventional charging device of AC bias contact charging type arose problems that, if the frequency of the AC component of the charging bias voltage is small, the charge unevenness is generated and that, if the frequency of the AC component of the charging bias voltage is increased, the service life of the image bearing body is shortened and the charging bias voltage source is made bulky to made the apparatus more expensive.

On the other hand, there has been proposed an image forming apparatus in which a character mode (suitable for a character image) having an image forming condition corresponding larger inclination y and a photograph mode (suitable for photographic (intermediate gradation) image) having an image forming condition corresponding to smaller inclination y are provided (here, the "inclination" is defined as inclination in a graph showing property of density of the outputted image with respect to density of an image of an original or an image signal inputted from an external equipment). In the image forming apparatus having such character mode and photograph mode, when the above-mentioned charging member to which the voltage including the AC component is used, it was found that a bad influence upon the image due to the charge unevenness generated in correspondence to the frequency of the AC component of the charging bias voltage becomes noticeable particularly in an intermediate density portion of the image.

Japanese Patent Application Laid-open No. 5-11571 discloses a technique in which the frequency of the AC component is switched between a character pattern and a graphic pattern, but does not disclose a mode for changing the inclination $\gamma$.

USP 5512982 discloses a technique in which the frequency is switched between a character mode and a photograph mode, but does not disclose a technique in which the inclination γ is changed in accordance with the modes.

SUMMARY OF THE INVENTION

An object of the present invention is to provide an image forming apparatus in which charge unevenness generated by an AC component of voltage applied to a charging member can be prevented from affecting a bad influence upon an image.

Another object of the present invention is to provide an image forming apparatus in which a power supply for applying voltage to a charging member can be prevented from becoming bulky and expensive and a service life of an image bearing body can be lengthened.

A further object of the present invention is to provide an image forming apparatus in which, in a mode having small inclination γ, unevenness in image is not generated by an AC component at an intermediate density portion.

The other objects and features of the present invention will be apparent from the following detailed explanation referring to the accompanying drawings.

DETAILED DESCRIPTION OF THE PREFERRED EMBODIMENTS

The present invention will now be fully explained in connection with embodiments thereof with reference to the accompanying drawings.

<First Embodiment>(FIGS. 1, 2A, 2B, 3A, 3B, 4A, 4B, 5A, 5B and 6)

1. Entire construction of image forming apparatus

Figure 6:
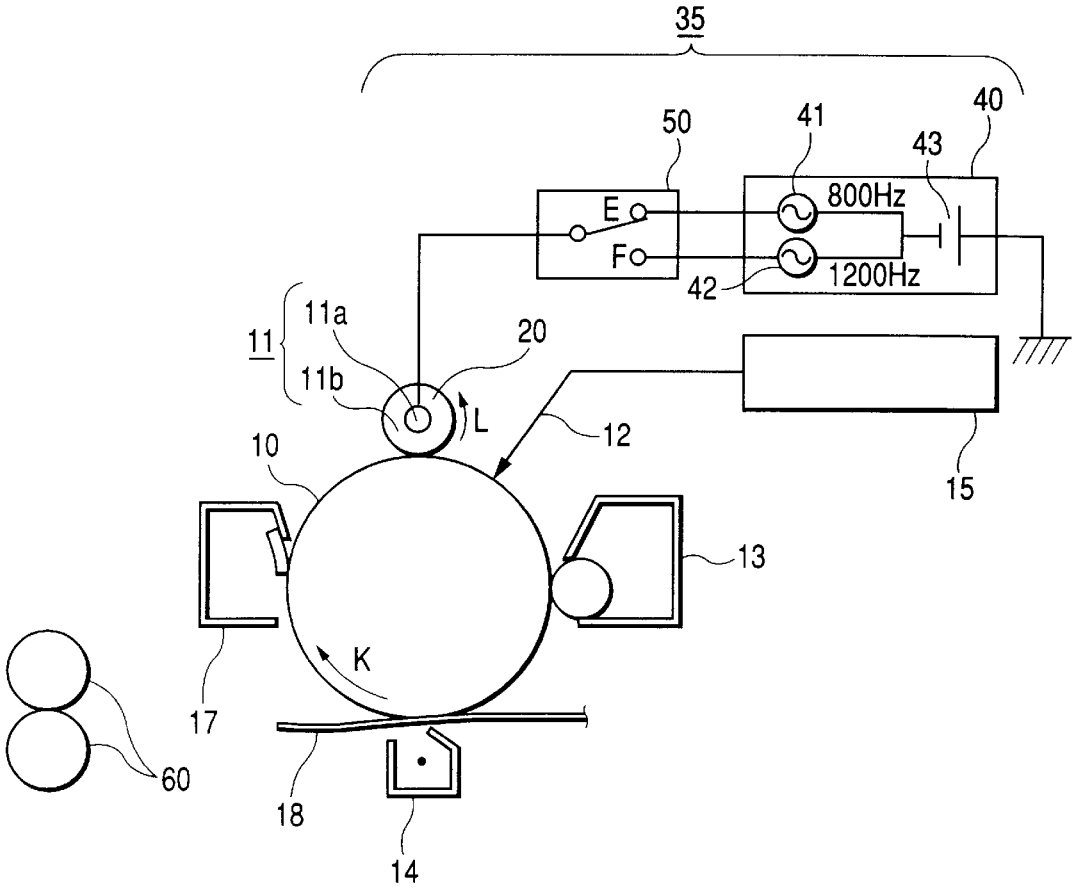
FIG. 6 is a sectional view showing a main portion of the image forming apparatus according to the first embodiment.

FIG. 6 is a sectional view showing a main portion of an image forming apparatus according to a first embodiment of the present invention. In FIG. 6, an image bearing body (photosensitive body) 10 is rotated at a predetermined process speed in a clockwise direction shown by the arrow K.

A first charging device 35 for uniformly charging an image bearing surface of the image bearing body 10 includes a charge roller (charging member of contact charging type) 11, a switching device 50 for switching frequency of charging bias voltage, and a charging bias voltage source 40.

An image exposure means 15 acts as a writing means for forming a latent image corresponding to an original image on the image bearing body 10 and serves to effect exposure by using illumination light (exposure light flux) 12 emitted from a light emitting means in response to a multi-value image signal inputted from an original reading means (not shown) or a host computer (not shown).

A developing device 13 serves to develop the latent image by applying toner to the latent image formed on the image bearing surface to visualize the image (as a toner image), a transfer means 14 serves to transfer the toner image onto a transfer material (recording material) 18, and a cleaning means 17 serves to remove residual toner and foreign matters remaining on the image bearing body after the transferring.

When the image formation (print) start is commanded, the image bearing body 10 is rotating driven. Meanwhile, the image bearing surface of the image bearing body 10 is uniformly charged by the first charging device 35, and the exposure light flux 12 from the image exposure means 15 is illuminated onto the charged image bearing surface to form the electrostatic latent image, and then, the electrostatic latent image is developed by the developing device 13 to form the toner image. At a predetermined timing synchronous with the formation of the toner image, the transfer material 18 supplied from a sheet supply portion (not shown) is supplied to a transfer station where the transfer means 14 is opposed to the image bearing body 10. At the transfer station, the toner image on the image bearing body is transferred onto the transfer material by applying transfer bias to a rear surface of the transfer material 18 from the transfer means 14. The transfer material to which the toner image was transferred is sent to a fixing device 60, where the toner image is thermally fixed to the transfer material. Thereafter, the transfer material is discharged out of the image forming apparatus as an output image.

Incidentally, after the transferring of the toner image, the residual matters remaining on the image bearing body 10 is removed by the cleaning means 17, and the cleaned image bearing surface is used for image formation again, and the above-mentioned first charging, exposure, developing, transferring and cleaning processes are repeated.

2. Schematic construction of first charging device 35

The charge roller 11 of the first charging device 35 is a rotatable cylindrical member constituted by a metallic core 11*a* and conductive or semi-conductive elastic member 11*b* surrounding the metallic core 11*a* and is urged against the image bearing body 10 with predetermined pressure by means of a pressurizing means (not shown), so that the charge roller 11 is rotatingly driven in a direction shown by the arrow L by rotation of the image bearing body 10 in a direction shown by the arrow K.

In synchronous with the image forming timing, by applying charging bias voltage including AC component and DC component to the metallic core 11*a* of the charge roller 11, the surface of the image bearing body 10 is charged with potential substantially equal to the DC component of the charging bias voltage.

The charging bias voltage source 40 includes a DC component power supply portion 43, a first AC component power supply portion 41 for generating AC component having first frequency, and a second AC component power supply portion 42 for generating AC component having second frequency.

In the illustrated embodiment, a value of output of the DC component power supply portion 43 is −750 [V], frequency of output of the first AC component power supply portion 41 is 800 (Hz) and frequency of output of the second AC component power supply portion 42 is 1200 (Hz). The outputs of the first and second AC component power supply portions 41, 42 are subjected to constant current control with 1.0 mA.

Figure 2A:
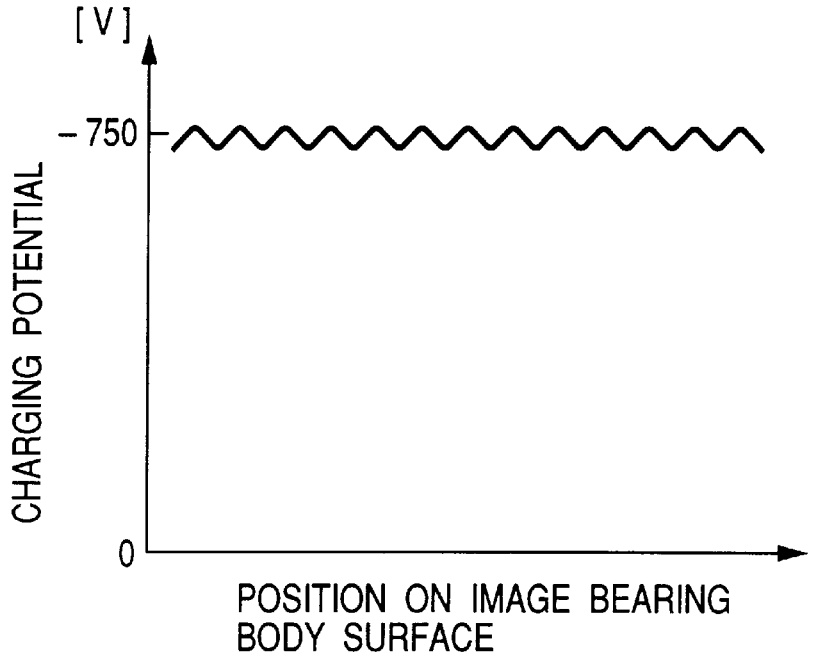
FIGS. 2A and 2B are views showing distribution of charging potential of a surface of an image bearing body after charging, according to the first embodiment.
Figure 2B:
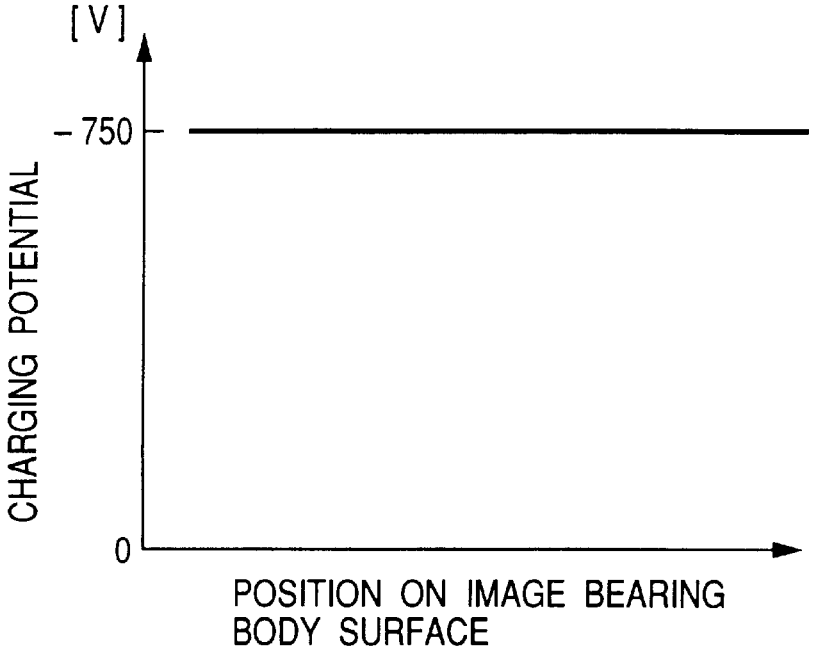

The charging bias voltage having the first frequency or second frequency detected by the frequency switching device 50 is applied to the charge roller 11. When the charging bias voltage having the first frequency is applied, distribution of charging potential of the surface of the image bearing body 10 is shown in FIG. 2A, and, when the charging bias voltage having the second frequency is applied, distribution of charging potential of the surface of the image bearing body 10 is shown in FIG. 2B.

When the charging bias voltage having the first frequency is applied, the surface of the image bearing body 10 is charged to about −750 [V], but has ripple of about 50 [V] (this ripple is the above-mentioned charge unevenness). On the other hand, when charging bias voltage having the second frequency is applied, the surface of the image bearing body 10 is uniformly charged to about −750 [V].

3. Mode selection

In the image forming apparatus according to the illustrated embodiment, there is provided a density output property selection switch (not shown) as a selection means for selecting a relation between density of the original image and density of the image outputted from the image forming apparatus (this relation is referred to as "density output property" hereinafter). The density output property can be selected from two modes, i.e., a character mode and a photograph mode.

The mode selected by the density output property selection switch is detected, and, by switching a light amount of the original illuminating light and developing bias voltage in accordance with the detected mode, the density output property is changed.

(3*a*) Exposure means

The exposure light flux 12 gives uniform light (referred to as "original illuminating light" hereinafter) to the surface of the original (not shown), and light reflected from the original is illuminated onto the image bearing body 10 through an optical system (not shown). The original illuminating light can be selected as a first light amount or a second light amount by means of a light amount switching device (not shown). Incidentally, the first light amount is larger than the second light amount. The first light amount is a light amount to the extent that photosensitive property of the image bearing body 10 is saturated, and the second light amount is a light amount to the extent that the photosensitive property of the image bearing body 10 becomes relatively linear.

Figure 3A:
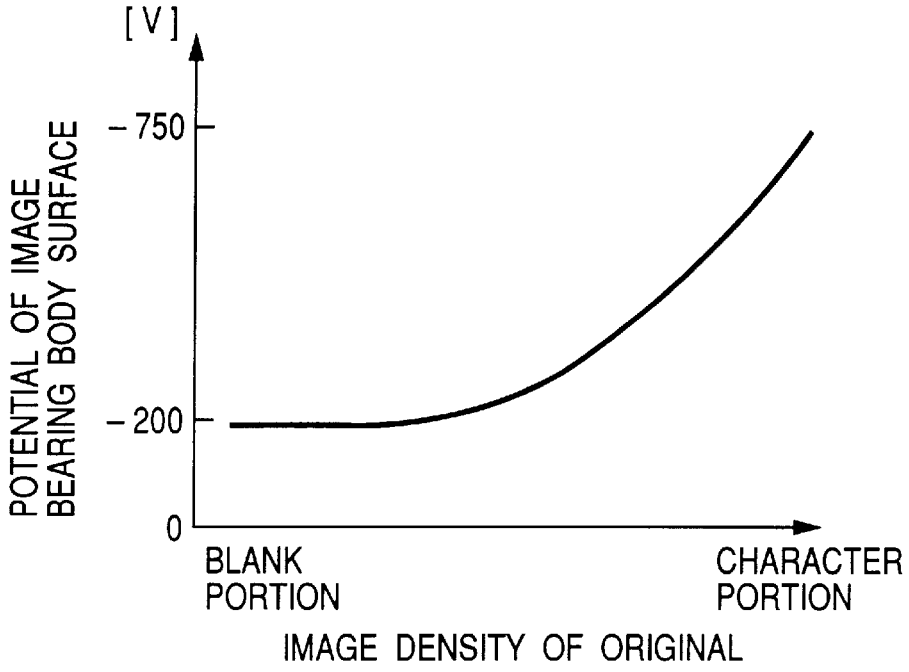
FIGS. 3A and 3B are graphs showing a relation between image density of an original image and potential of the surface of the image bearing body, according to the first embodiment.
Figure 3B:
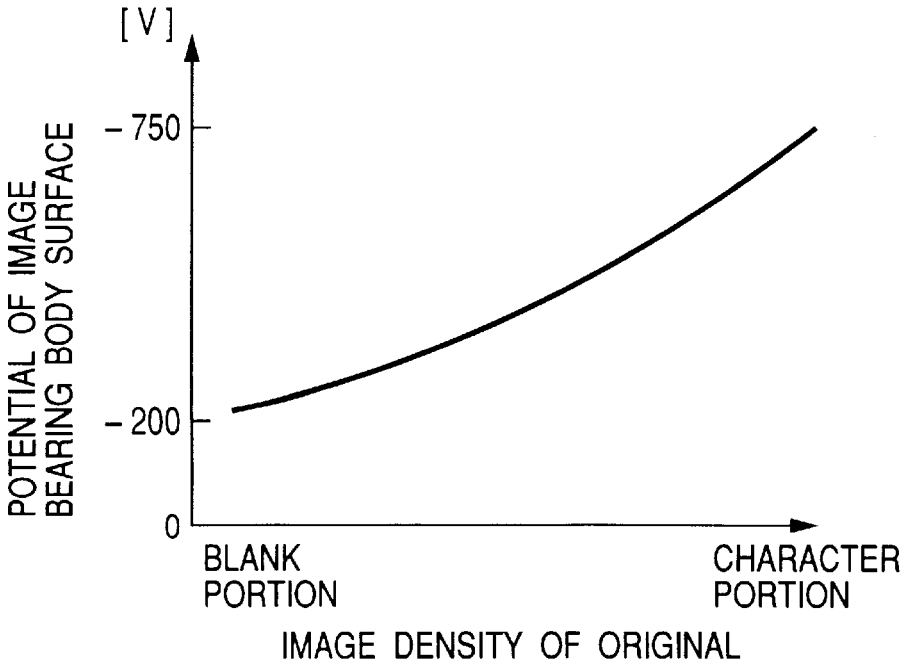

When the exposure light flux 12 having the first light amount is illuminated, a relation between the image density of the original image and the potential of the surface of the image bearing body 10 after illumination of the exposure light flux 12 is shown in FIG. 3A, and, when the exposure light flux 12 having the second light amount is illuminated, a relation between the image density of the original image and the potential of the surface of the image bearing body 10 after illumination of the exposure light flux 12 is shown in FIG. 3B.

(3*b*) Switching of developing bias

In the developing device 13, the frictionally charged toner is coated on a developer bearing body (developing sleeve) to which the developing bias is applied, and the coated toner is adhered to the surface of the image bearing body 10 by an electric field generated between the developer bearing body and the electrostatic latent image on the image bearing body, thereby effecting the development.

The developing bias voltage applied to the developer bearing body can be selected as first developing bias voltage (developing bias voltage including DC component of −300 [V] and AC component of 1300 [$V_{p-p}$]) or second developing bias voltage (developing bias voltage including DC component of −300 [V] and AC component of 900 [$V_{p-p}$]) by means of a developing bias switching device (not shown). The first developing bias voltage has abrupt slope of property and is suitable for obtaining adequate density in character images. On the other hand, the second developing bias voltage has relatively gentle slope within a range of potential of the electrostatic latent image and is suitable for expressing gradation.

Figure 4A:
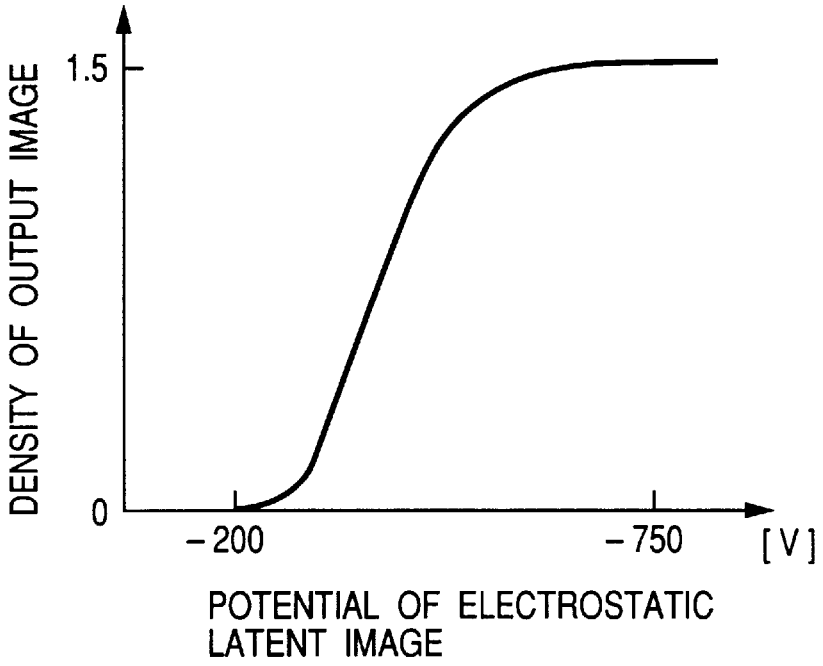
FIGS. 4A and 4B are graphs showing a relation between potential of an electrostatic latent image on the surface of the image bearing body and density of an output image, according to the first embodiment.
Figure 4B:
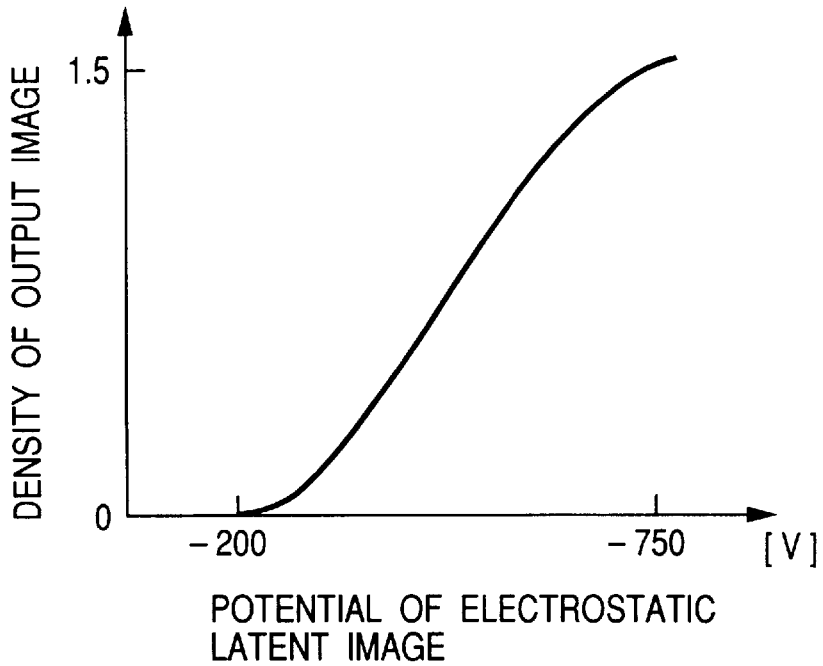

FIGS. 4A and 4B show relations between the potential of the electrostatic latent image on the image bearing body and the density of the output image (after the electrostatic latent image was developed, the toner image was transferred and the toner image was fixed). Particularly, FIG. 4A shows a relation between the potential due to the first developing bias voltage and the density, and FIG. 4B shows a relation between the potential due to the second developing bias voltage and the density.

(3*c*) Example of switching of density output property

Figure 5A:
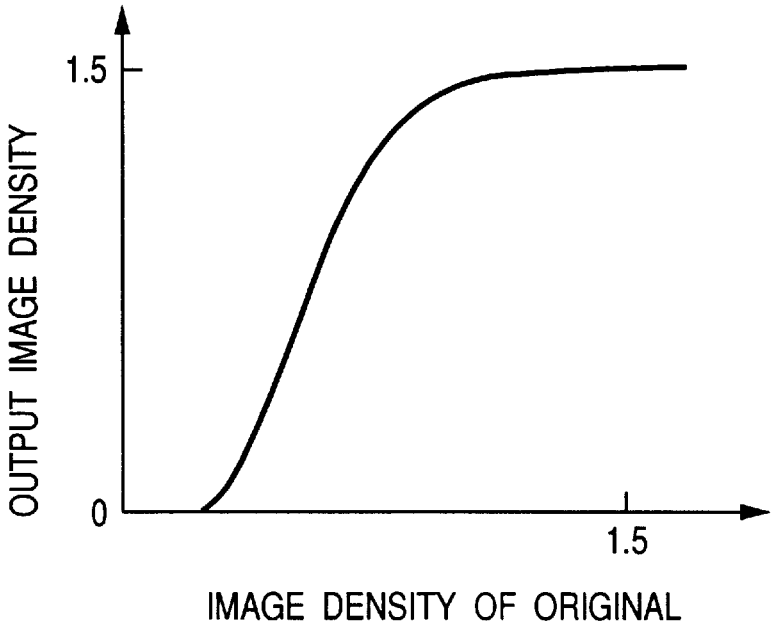
FIGS. 5A and 5B are graphs showing density output properties of a character mode and a photograph mode, according to the first embodiment.

When the character mode is selected, the image formation is performed by using the original illuminating light having the first light amount (large) and the first developing bias voltage (1300 $V_{p-p}$). When the image formation is performed under this condition, by the properties shown in FIGS. 3A and 4A, the density output property with respect to the density of the original image becomes as shown in FIG. 5A so that an image in which a background (white portion) of the original image is reproduced as complete white and characters and low density fine lines are recognized clearly can be outputted.

Figure 5B:
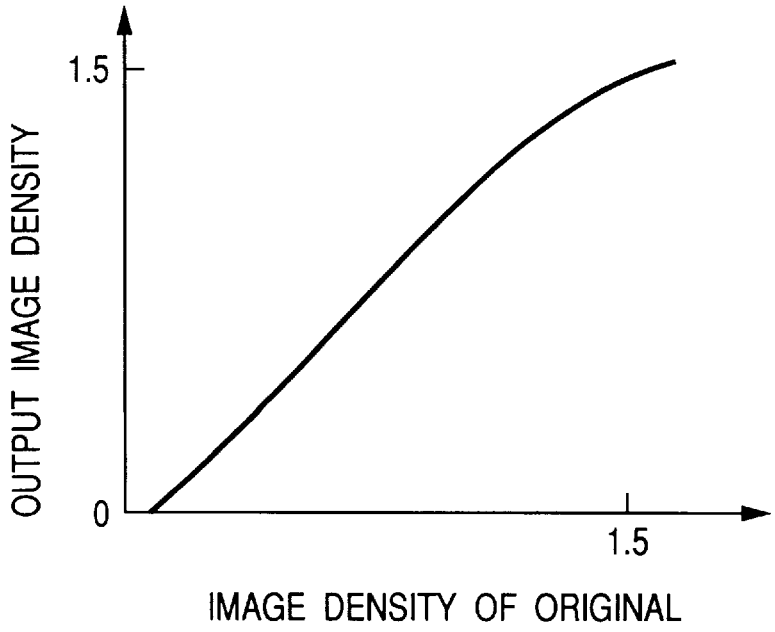

On the other hand, when the photograph mode is selected, the image formation is performed by using the original illuminating light having the second light amount (small) and the second developing bias voltage (900 $V_{p-p}$). When the image formation is performed under this condition, by the properties shown in FIGS. 3B and 4B, the density output property with respect to the density of the original image becomes as shown in FIG. 5B so that, since the intermediate density portions of the original image are reproduced with true density, an image having good gradation can be outputted.

In this way, the image forming condition is set so that the inclination $\gamma$ of the density property of the output image with respect to the density of the original image in the character mode becomes larger than that in the photograph mode.

4. Changing of charging bias voltage

In the illustrated embodiment, the frequency switching device 50 detects which mode (character mode or photograph mode) was selected, and the charging bias voltage is changed on the basis of the selected mode. In this case, it is considered that the detection of the mode selected is equivalent to detection of information regarding a condition of the output image which will be described hereinbelow.

When the character mode is selected, due to the density output property, the magnitude of the intermediate density portions in the output image is largely reduced in comparison with the magnitude of the intermediate density portions in the original image. Further, the fact itself that an operator of the image forming apparatus selects the character mode means that the original image does not include the intermediate density portions (which require gradation expression) so much. That is to say, at the time when the character mode is selected, it is judged that the magnitude or ratio of the intermediate density portions in the output image is small.

On the other hand, when the photograph mode is selected, due to the density output property, the magnitude of the intermediate density portions in the output image is equal to the magnitude of the intermediate density portions in the original image. Further, the fact itself that the operator of the image forming apparatus selects the photograph mode means that the original image include much intermediate density portions (which require gradation expression). That is to say, at the time when the photograph mode is selected, it is judged that the magnitude or ratio of the intermediate density portions in the output image is large.

The fact that the charging bias voltage is controlled on the basis of the detected mode detected by the density output property selection switch is equivalent to the fact that the charging bias voltage is controlled on the basis of the magnitude or ratio of the intermediate density portions in the output image.

Figure 1:
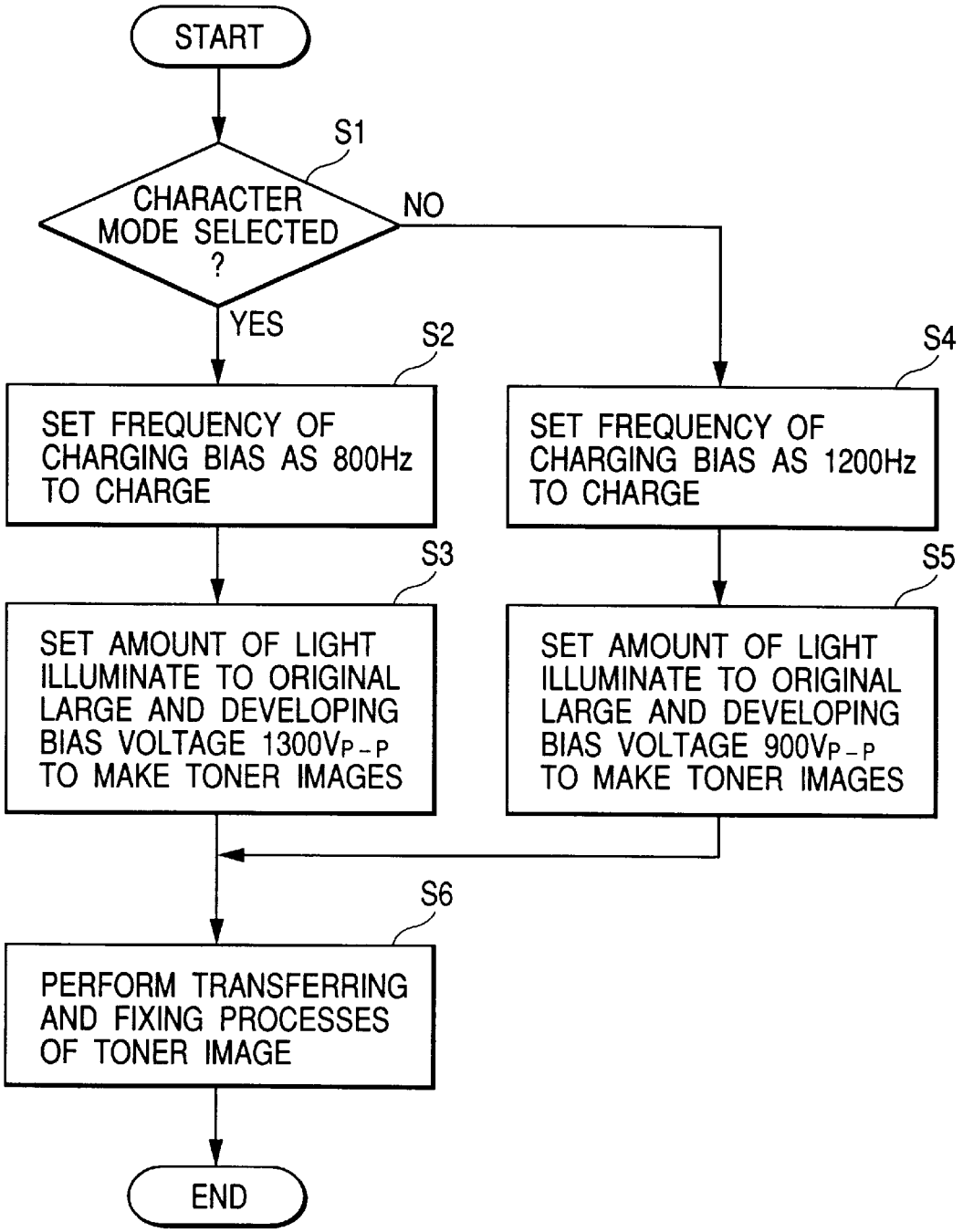
FIG. 1 is a flow chart showing a characteristic operation of an image forming apparatus according to a first embodiment of the present invention.

Next, the control of the charging bias voltage will be explained with reference to a flow chart shown in FIG. 1.

First of all, the mode selected by the density output property selection switch is detected by a property detecting means (not shown) (step 1), and the frequency of the charging bias voltage is changed by the frequency switching device 50 on the basis of the detected mode.

If the character mode is selected, the charging bias voltage having the first frequency (800 Hz) is applied to the charge roller 11 by the frequency switching device 50, thereby charging the surface of the image bearing body 10 (step 2).

The original illuminating light is set to the first light amount and the developing bias voltage is set to the first developing bias voltage, and the image formation (formation of toner image) is performed (step 3). Then, the toner image is transferred onto the transfer material 18 and then is fixed to the transfer material, and, thereafter, the transfer material is outputted (step 6).

When the charging is effected with the charging bias voltage having the first frequency (800 Hz) in this way, although the charging potential of the surface of the image bearing body 10 includes the ripple of about 50 [V], in the image including no intermediate density portion, the ripple of the charging potential does not affect a bad influence upon the image for the following reason.

In the character mode, i.e., in the image including no intermediate density portion, there are only white portions and character portions. As shown in FIG. 3A, the potential of the white portion corresponds to an area where the photosensitive property of the image bearing body 10 is saturated, the potential of the white portion after the image exposure does not include the ripple. Although the charging potential of the character portion includes the ripple as it is, as shown in FIG. 4A, since the property of the developing device is saturated, the ripple of the charging potential does not affect a bad influence upon the character portion.

On the other hand, if it is judged that the photograph mode is selected in step 1, the charging bias voltage having the second frequency (1200 Hz) is applied to the charge roller 11 by the frequency switching device 50, thereby charging the surface of the image bearing body 10 (step 4).

The original illuminating light is set to the second light amount and the developing bias voltage is set to the second developing bias voltage, and the image formation (formation of toner image) is performed (step 5). Then, the toner image is transferred onto the transfer material 18 and then is fixed to the transfer material, and, thereafter, the transfer material is outputted (step 6).

When the charging is effected with the charging bias voltage having the second frequency (1200 Hz) in this way, since the surface of the image bearing body 10 is uniformly charged with −750 [V], even in the image including much intermediate density portion, high quality image having no density unevenness can be outputted.

According to the illustrated embodiment, the high quality image can always be outputted even in the character mode or the photograph mode, and, since the frequency of the charging bias voltage is increased only when required (only in the photograph mode for reproducing the intermediate density portion), the damage of the image bearing body can be suppressed to the minimum.

Namely, the high quality image can be obtained and the service life of the image bearing body can be lengthened, with the simple and cheap construction.

Incidentally, in the illustrated embodiment, while an example that the present invention is applied to the copying machine of analogue type was explained, the present invention is not limited to such an example, but may be applied to a copying machine of digital type so long as there are provided a selection means capable of selecting density output properties such as a character mode and a photograph mode and a detection means for detecting the selected property and the charging bias voltage is controlled to be switched on the basis of the selected property.

Further, in case of the copying machine of digital type, it is desirable that the switching of the density output property in the character mode and the photograph mode is effected by using a gamma (γ) conversion table indicating laser output properties with respect to image signals inputted from an external equipment, and, the switching of the light amount of the original illuminating light and the switching of the magnitude of $V_{p\text{-}p}$ of the AC component of the developing bias voltage are not required.

In the illustrated embodiment, while an example that the frequency of the charging bias voltage in the character mode is selected to 800 Hz and the frequency of the charging bias voltage in the photograph mode is selected to 1200 Hz was explained, it is desirable that optimum frequency is selected in accordance with boundary conditions of the first charging portion such as a shifting speed of the image bearing body of the image forming apparatus, a curvature of the image bearing body at the first charging portion and a diameter of the charge roller.

<Second Embodiment>

Next, a second embodiment of the present invention will be explained. Incidentally, the same elements as those in the first embodiment are designated by the same reference numerals and explanation thereof will be omitted.

In the second embodiment, the present invention is applied to an image forming apparatus for forming a toner image corresponding to multi-value image signals, as is in a digital copying machine and a digital laser printer.

Incidentally, in the second embodiment, a means for detecting the magnitude or ratio of the intermediate density portion in the output image outputted from the image forming apparatus differs from that in the first embodiment, and there is no means for switching the light amount of the original illuminating light and the magnitude of $V_{p\text{-}p}$ of the AC component of the developing bias voltage. The other construction is the same as that in the first embodiment.

The exposure light flux 12 in the second embodiment corresponds to a multi-value image signals having 256 levels (from 0 to 255) with a resolving power of 400 dpi. Accordingly, an A4 size image includes about 15,000,000 pixels.

Figure 7:
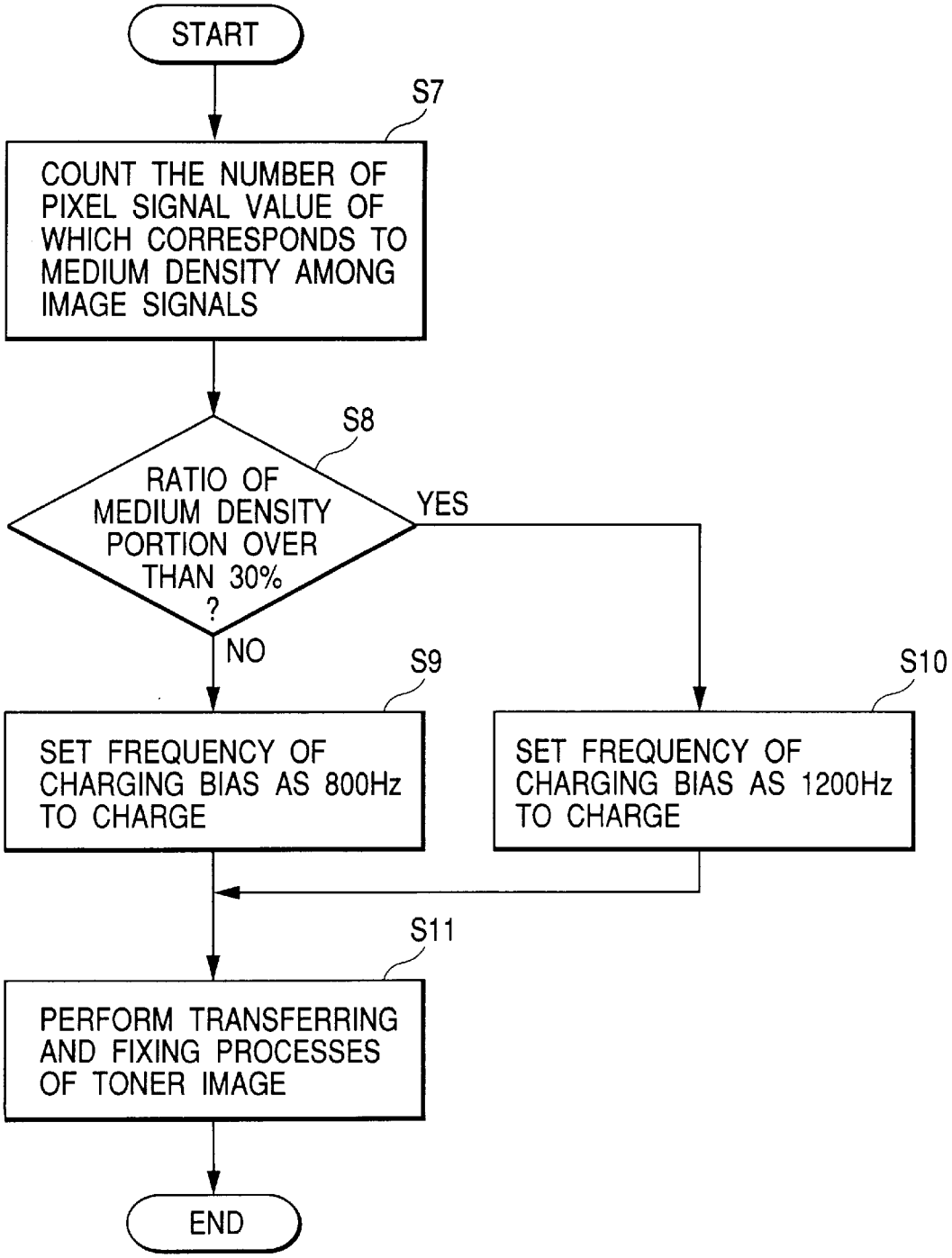
FIG. 7 is a flow chart showing a characteristic operation of an image forming apparatus according to a second embodiment of the present invention.

FIG. 7 is a flow chart showing an operation of the image forming apparatus according to the second embodiment.

In the illustrated embodiment, before the surface of the image bearing body 10 is uniformly charged by the first charging device 35, the number of pixels having signal values corresponding to a predetermined density area (for example, logarithmic reflection density of 0.3 to 1.0) among the multi-value image signals used for image formation is counted (step 7). Namely, if it is assumed that the multi-value image signals (from 0 to 255) represent density values from 0.05 to 1.50, the number of pixels having signal values larger than 44 and smaller than 168 may be counted.

If the number of pixels in the intermediate density portion so counted does not exceed 30% of the entire number of pixels (15,000,000), it is judged that the ratio of the intermediate density portion is small (step 8).

In correspondence to the magnitude of the ratio of the intermediate density portion so determined, the charging bias voltage of the first charging device 35 is switched. If the ratio of the intermediate density portion is small, the surface of the image bearing body 10 is charged by the first frequency (800 Hz) (step 9); whereas, if the ratio of the intermediate density portion is large, the surface of the image bearing body 10 is charged by the second frequency (1200 Hz) (step 10).

The toner image is formed on the charged surface of the image bearing body 10, and the toner image is transferred onto the transfer material 18 and then is fixed to the transfer material, and, thereafter, the transfer material is outputted (step 11).

In this way, in the illustrated embodiment, when the image including small intermediate density portion is outputted, since the character mode is automatically selected to switch to the relatively low frequency, the scraping of the surface of the image bearing body 10 can be suppressed to the minimum. In the image including small intermediate density portion, since a portion in which image quality is reduced by the influence of the charge unevenness is very small, high quality of the output image is maintained.

When the image including large intermediate density portion is outputted, since the photograph mode is automatically selected to switch to the relatively high frequency which does not generate the charge unevenness, the high quality image having no density unevenness can be obtained.

The output of the laser is so set that the inclination $\gamma$ of the property of the density of the output image with respect to the image signal inputted from the external equipment in the photograph mode becomes smaller than the inclination in the character mode.

In the illustrated embodiment, the type of the image ("largeness" or "smallness" of the ratio or magnitude of the intermediate density portion in the image) can be judged more correctly than the first embodiment.

With the arrangement as mentioned above, since the pixels corresponding to the background portion (white portion) of the image was counted, since the toner image is not formed on the background portion, there is no relation to the density unevenness due to the charge unevenness.

By using a counting method which will be described hereinbelow, the ratio of the intermediate density portion in the image in which the charge unevenness affects an influence upon the image quality can be judged more correctly.

First of all, the number of pixels of the signal values corresponding to the intermediate density portion is counted, and at the same time, the number of pixels of the signal values corresponding to the background portion (white portion) of the image is counted. For example, the number of pixels having logarithmic reflection density of 0.2 or less and signal values of 26 or less is counted. Then, if the number of pixels of intermediate density exceeds 30% of the number obtained by subtracting the number of pixels corresponding to the background portion from the total number of pixels, it is judged that the ratio of the intermediate density portion in the image outputted in response to this image signal is large to automatically select the photograph mode; whereas, if such number of pixels does not exceed 30%, it is judged that the ratio of the intermediate density portion is small to automatically select the character mode.

In the illustrated embodiment, the intermediate density area is not limited to 0.3 to 1.0 but may be determined on the basis of the charging property of the first charging device, the photosensitive property of the image bearing body and the developing property of the developing device used with the image forming apparatus. If the frequency of the AC component of the charging bias voltage of the first charging device is low, it is desirable that a density area in which the density unevenness corresponding to such frequency is generated is regarded as the intermediate density portion.

In the illustrated embodiment, the ratio as a reference for judging the largeness or smallness of the ratio of the intermediate density portion is not limited to 30%. So long as the reference ratio is set to 20%–80% according to the operator's preference, the effect of the present invention is fully expected.

<Third Embodiment>

In the present invention, the effect of the invention is further promoted when the number of pixels of the intermediate density portion is counted regarding a signal after an image signal process or treatment for changing the image signal value (such as gamma conversion for converting the image signal inputted from the external equipment into the output image signal) (image signal treatment for converting the image signal into the density value) or an image signal treatment for adding a new intermediate density image portion to the original image signal (such as a shading treatment) is performed.

Further, the present invention is effective to an image forming apparatus in which an image corresponding to a binary image signal obtained by binarizing the multi-value signal is formed.

In this case, the ratio or magnitude of the intermediate density portion may be judged on the basis of the magnitude of the image signal value of the multi-value signal before converted into the binary image signal.

Figure 8:
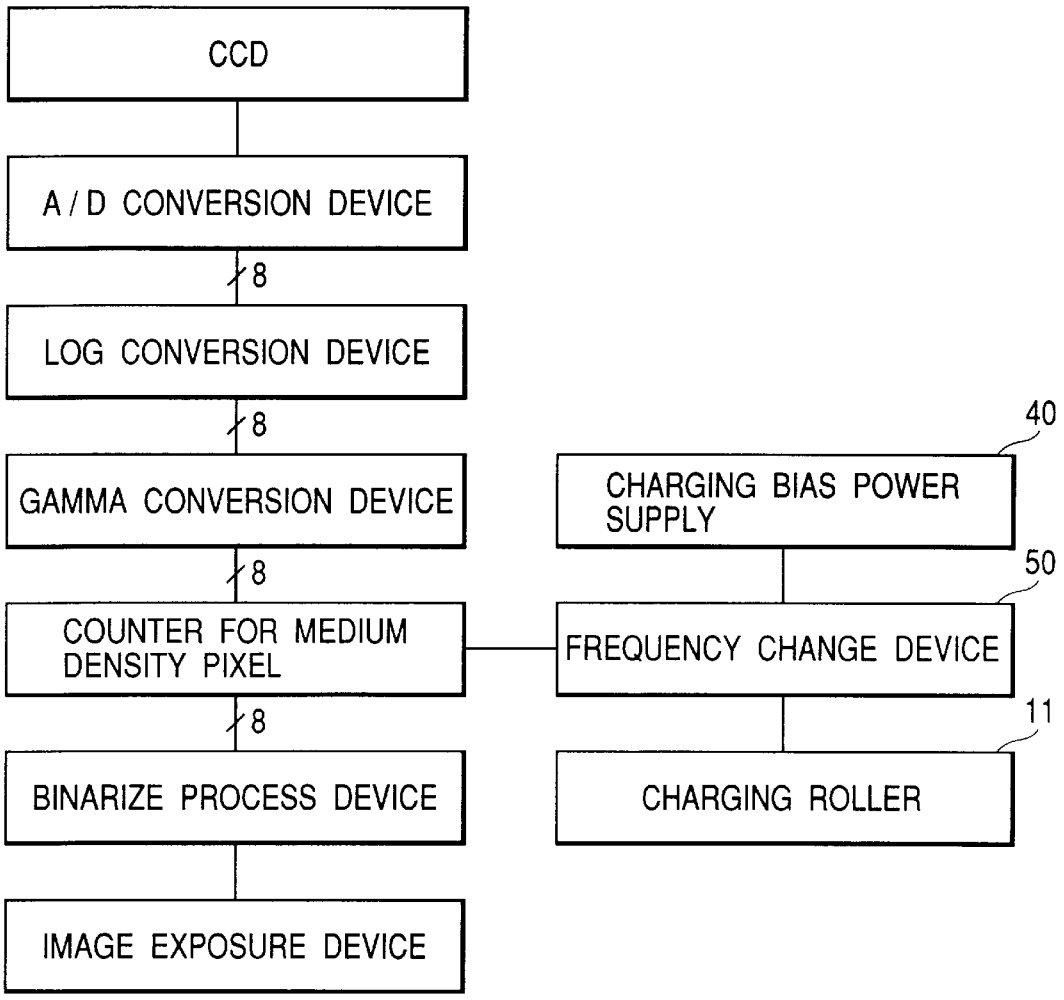
FIG. 8 is a block diagram of an image forming apparatus according to a third embodiment of the present invention.
Figure 9:
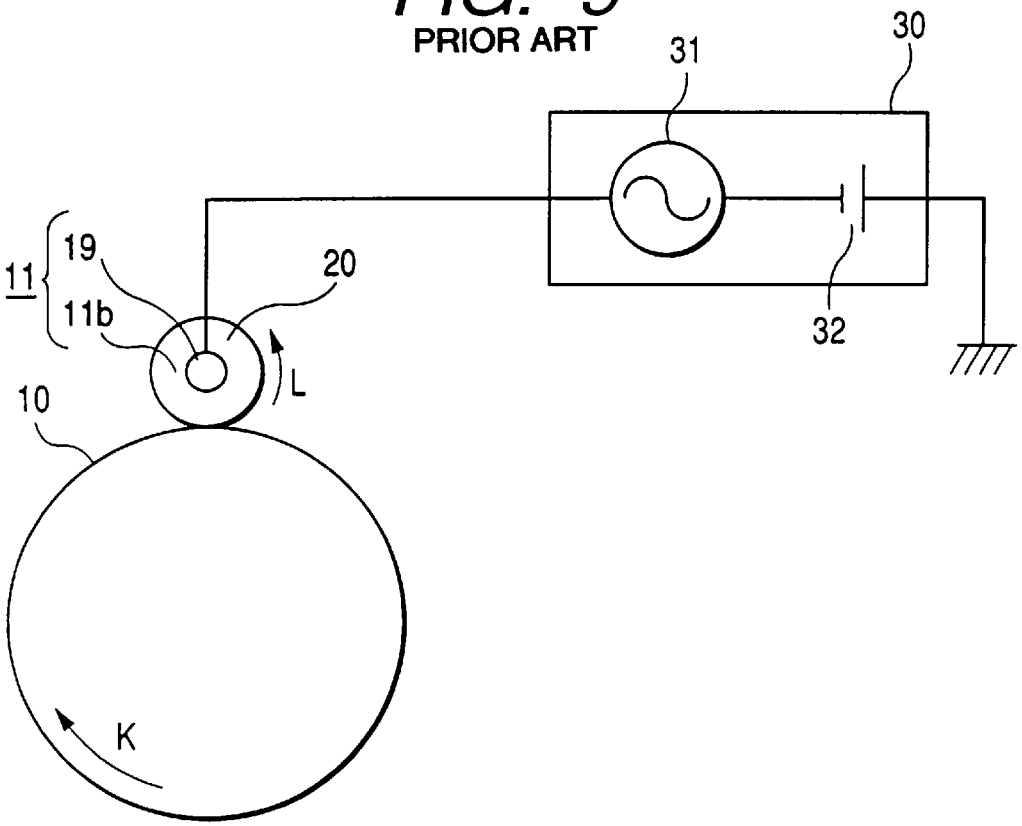
FIG. 9 PRIOR ART
FIG. 9 is a view showing an example of a conventional charging device of contact charging type.
Figure 10:
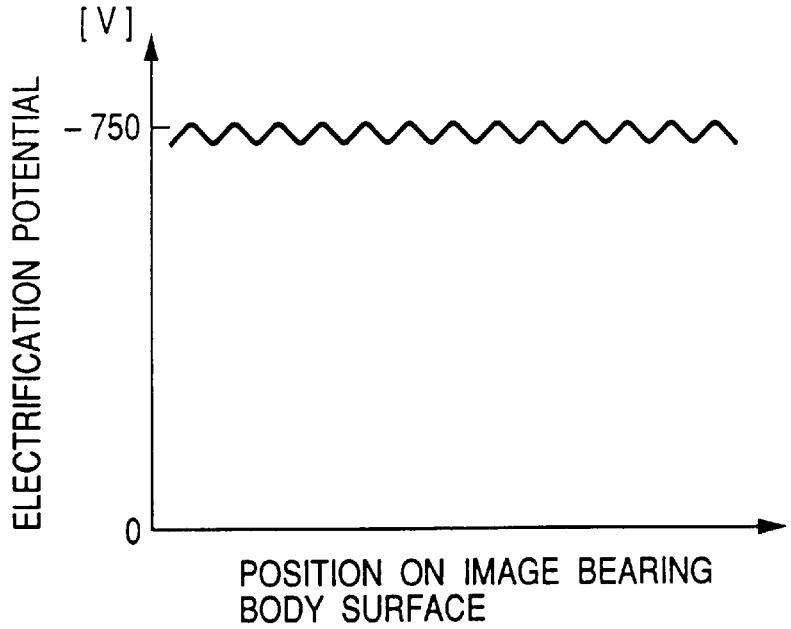
FIG. 10 is a view showing an example of charge unevenness as distribution of charging potential.

FIG. 8 is a block diagram of an image forming apparatus (to which the present invention is applied) in which, after the multi-value image signal is binarized, the image formation is performed.

Image information read by a CCD is converted into a multi-value image illuminance signal having 256 level by an A/D conversion device, and the image illuminance signal is converted into a multi-value image density signal having 256 level by a LOG conversion device, and the, the image density signal is converted into density output property according to the operator's preference by a gamma conversion device. After the number of pixels of the intermediate density portion included in the gamma-converted image signal is counted, the gamma-converted image signal is converted into a binary image signal by binarize process device, and then, the binary image signal is sent to an image exposure device. In this case, the number of pixels of the intermediate density regarding the gamma-converted image signal is counted, and the frequency of the charging bias voltage to be applied to the charge roller 11 is switched by the frequency switching device 50 in accordance with the counted result. By doing so, even in the image forming apparatus in which the image formation is effected on the basis of the binary image signal, the high quality image can be obtained and the service life of the image bearing body can be lengthened.

Incidentally, in the illustrated embodiment, while an example that the member of electrophotographic process type using the photosensitive body is used as the image bearing body was explained, the present invention is not limited to such an example, but, a member of electrostatic recording process type using electrostatic recording dielectric body may be used as the image bearing body. In this case, after the surface of the dielectric body is uniformly charged, by selectively removing electricity from the charged surface by means of an electricity removing means such as an electricity removing head or an electronic gun, an electrostatic latent image corresponding to an output image is written on the surface of the dielectric body. Similar to the illustrated embodiments, the frequency of the charging bias voltage for effecting the charging may be switched in accordance with the ratio or magnitude of the intermediate density portion in the output image.

Incidentally, it is desirable that peak-to-peak voltage of the AC component of the voltage applied to the charging member is larger than an absolute value of the charging start voltage of the image bearing body by two times or more, regardless of the character mode and the photograph mode. Incidentally, when only the DC voltage is applied to the charging member, the charging start voltage of the image bearing body is a minimum applied DC voltage value for starting the charging of the image bearing body.

Further, in the illustrated embodiment, the AC component applied to the charging member includes a rectangular wave form formed by turning the DC power supply ON and OFF periodically.

What is claimed is:

1. An image forming apparatus comprising:

a photosensitive body;

a charging member for charging said photosensitive body;

voltage applying means for applying a voltage including an AC component to said charging member;

exposing means for image exposing on said photosensitive body charged by said charging member to form an electrostatic image; and developing means for developing the electrostatic image;

wherein said image forming apparatus can select from a first mode having low tone reproductivity and a second mode having tone reproductivity higher than that of the first mode, and wherein, when the second mode is selected, said voltage applying means applies a voltage having a frequency of the AC component higher than that when the first mode is selected.

2. An image forming apparatus according to claim 1, wherein the first mode is suitable for character image formation and the second mode is suitable for photograph.

3. An image forming apparatus according to claim 1, where in said exposing means changes an exposure light amount between when the first mode is selected and when the second mode is selected.

4. An image forming apparatus according to claim 1, wherein said developing means changes a developing condition between when the first mode is selected and when the second mode is selected.

5. An image forming apparatus according to claim 1, wherein said charging member contacts with said photosensitive body and said voltage applying means applies the AC component controlled with constant current to said charging member.

6. An image forming apparatus according to claim 5, a target value of control with constant current when the first mode is selected and a target value of that when the second mode is selected is common.

7. An image forming apparatus according to claim 1, further comprising selecting means for selecting a mode on the basis of an image information.

* * * * *

UNITED STATES PATENT AND TRADEMARK OFFICE

CERTIFICATE OF CORRECTION

PATENT NO. : 5,991,557

DATED : November 23, 1999

INVENTORS : Tsuyoshi Kunishi, et al.

It is certified that error appears in the above-identified patent and that said Letters Patent is hereby corrected as shown below:

COLUMN 2

Line 35, "must" should read --must be--;
Line 47, "y" should read --γ--; and
Line 50, "y" should read --γ--.

COLUMN 12

Line 23, "where in" should read --wherein--.

Signed and Sealed this

Twelfth Day of September, 2000

*Attest:*

Q. TODD DICKINSON

*Attesting Officer*

*Director of Patents and Trademarks*